United States Patent [19]

Lindquist et al.

[11] Patent Number: 4,708,667

[45] Date of Patent: Nov. 24, 1987

[54] CONNECTOR TEST ADAPTER

[75] Inventors: Craig B. Lindquist, Goodrich, Mich.; Robert F. Bihn, North Olmsted, Ohio

[73] Assignee: Kent-Moore Corporation, Warren, Mich.

[21] Appl. No.: 837,806

[22] Filed: Mar. 10, 1986

[51] Int. Cl.[4] ..... H01R 35/02

[52] U.S. Cl. ..... 439/788

[58] Field of Search ..... 339/256 S, 256 RT, 255 RT

[56] References Cited

U.S. PATENT DOCUMENTS

| | | | |
|---|---|---|---|
| 1,657,253 | 1/1928 | Fortin | 339/256 S |
| 2,427,001 | 9/1947 | Hubbell et al. | 339/256 S |
| 2,890,266 | 6/1959 | Bollmeier | 339/256 S |
| 3,614,296 | 10/1971 | Blomstrand | 339/256 S |
| 4,466,690 | 8/1984 | Osypka | 339/256 S |

FOREIGN PATENT DOCUMENTS

| | | | |
|---|---|---|---|
| 2426544 | 12/1974 | Fed. Rep. of Germany | 339/256 S |
| 803640 | 10/1958 | United Kingdom | 339/256 S |
| 681487 | 8/1979 | U.S.S.R. | 339/256 S |

*Primary Examiner*—Z. R. Bilinsky
*Assistant Examiner*—Daniel W. Howell
*Attorney, Agent, or Firm*—Barnes, Kisselle, Raisch, Choate, Whittemore & Hulbert

[57] ABSTRACT

A connector test adapter comprising a closely wound spring comprising a first portion having one diameter and a second portion having a larger diameter. A connector tip is fastened to the first portion and projects beyond the end thereof and the second portion is adapted to function as a banana jack receiving a banana plug. The entire spring is enclosed in a plastic insulating sleeve and the sleeve projects beyond the second portion of the spring.

4 Claims, 12 Drawing Figures

CONNECTOR TEST ADAPTER

This invention relates to connector test adapters.

BACKGROUND AND SUMMARY OF THE INVENTION

In electrical harnesses such as are used in automobiles, it has become conventional to utilize connectors of both the male and female type which have closely spaced contacts. The close spacing of the contacts makes it difficult for connecting to the contacts as in testing continuity, signal or voltage. One type of connector test adapter that has heretofore been suggested, the contact tip is clinched to a wire at one end and the wire is in turn connected to a tubular machined part at the other end that functions as a jack or socket for receiving a banana clip of a wire that extends to the test instrument. A plastic insulation is provided over the wire and the metal part. In order to permit close spacing, the wire is manually bent.

One of the problems with such an arrangement is that the continual bending of the wire results in breakage and lessens the life of the connector test adapter.

Accordingly among the objectives of the present invention are to provide a connector test adapter which can be repeatedly used and permits connection to closely spaced contacts of a connector; which is easier to manufacture; which has a long life; and which can be readily color coded for connector tips of various types.

In accordance with the invention, the connector test adapter comprises a closely wound spring comprising a first portion having one diameter and a second portion having a larger diameter. A connector tip is fastened to the first portion and projects beyond the end thereof and the second portion is adapted to function as a banana jack receiving a banana plug. The entire spring is enclosed in a plastic insulating sleeve and the sleeve projects beyond the second portion of the spring.

DESCRIPTION

Figure 1:
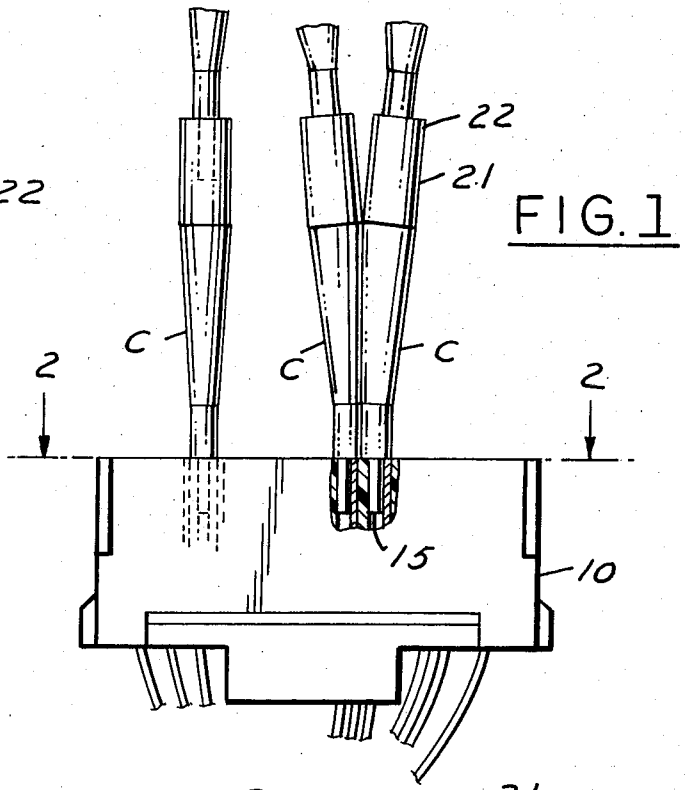
FIG. 1 is an elevational view of a plurality of connector test adapters utilized on a connector.
Figure 3:
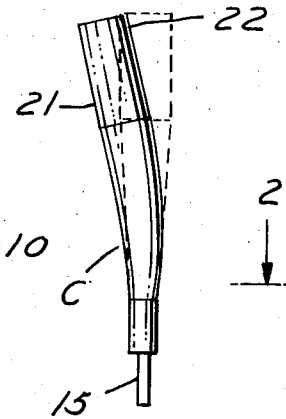
FIG. 3 is an elevational view of a connector test adapter.
Figure 2:
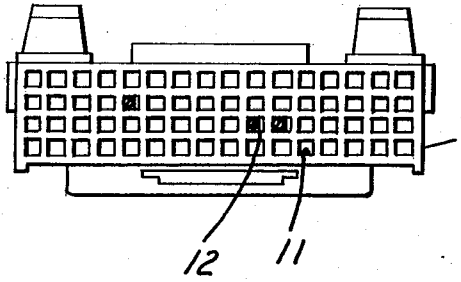
FIG. 2 is a sectional view taken along line 2—2 in FIG. 1.
Figure 4:
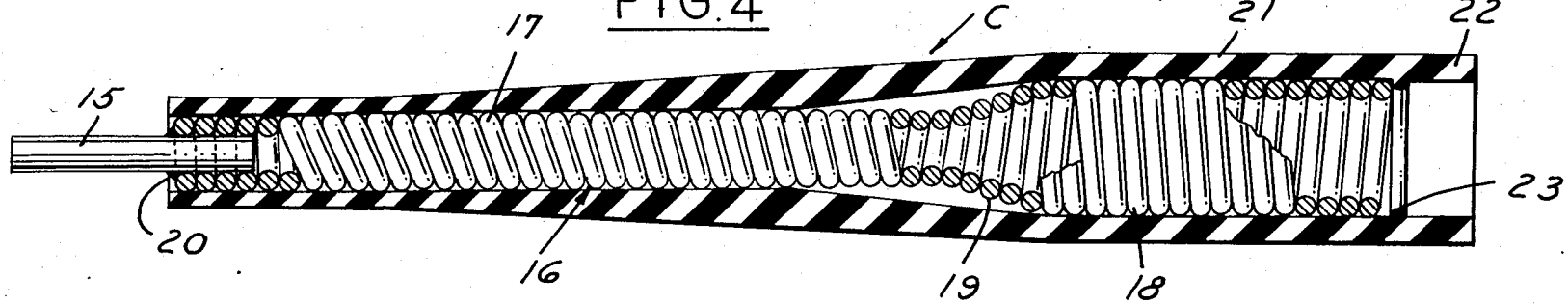
FIG. 4 is a longitudinal sectional view on an enlarged scale of the the connector test adapter.

Referring to FIG. 1, the connector test adapter embodying the invention is adapted to be used with a connector 10 having a plurality of closely spaced openings 11 which support either male or female contacts. As shown in FIGS. 1 and 2, the contacts 12 are of the socket or female type.

The connector test adapter C embodying the invention must be capable of flexing or bending in order to permit circuits to be made to closely spaced contacts as shown to the right in FIG. 1.

In accordance with the invention the connector C comprises a connector tip 15 that has the desired configuration to engage either a socket or a pin on the connector 10. One end of the tip 15 is fastened to a closely wound spring 16. The spring 16 includes a first portion

17 of substantially constant internal and external diameter and a second portion 18 of substantially constant larger internal and external diameter connected by an intermediate portion 19. The connector tip 15 extends into the portion 17 and is fixed thereto as by soldering as at 20. The second portion 18 of the spring functions as a jack or socket for receiving a banana plug which is attached to a wire extending to the test instrument.

A sleeve 21 of insulating plastic material such as vinyl is telescoped over the spring 16 and has an internal configuration similar to the external configuration of the spring 16. The sleeve 21 covers the free end of the portion 17 at one end and extends beyond the free end of the portion 18 as at 22 at the other end. The portion 22 extends beyond the free end in order to electrically isolate that portion from the fingers of the person utilizing the connector test adapter. The sleeve 21 includes an internal rib 23 that engages the free end of the portion 18 of the spring 16 to impede any tendency of the spring to move axially outwardly in use. Alternatively, solder on the exterior of second portion 18 functionally inhibits relative movement between the spring 16 and sleeve 21.

As shown in FIG. 1, when the connectors C are utilized in closely spaced relationship they can flex at the portion 17 to permit the use in the adjacent contacts which are close to one another.

Although the invention has been shown as being utilized with a connector pin 15 that engages a socket for a female contact, it may also be utilized by replacing the connector pin 15 with a connector pin that is hollow for engagement with a male or pin type contact on the connector.

Figure 5A:
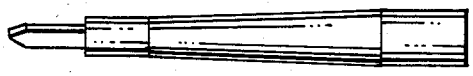
FIGS. 5A–H are elevational views of connector test adapters.
Figure 5B:
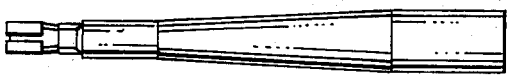
Figure 5C:
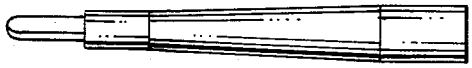
Figure 5D:
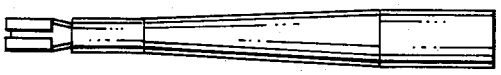
Figure 5E:
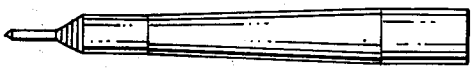
Figure 5F:
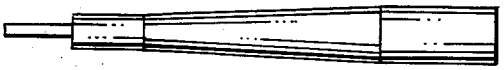
Figure 5G:
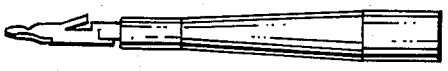
Figure 5H:
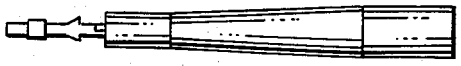

The various types of connector pins that can be utilized are shown in FIG. 5 wherein FIG. 5A shows a flat male connector; FIG. 5B shows a sheet metal connector; FIG. 5C shows a flat connector with a rounded end; FIG. 5D shows a flat metal connector of a different type; FIG. 5E shows a small pointed connector tip; FIG. 5F shows a cylindrical tip; FIG. 5G shows a sheet metal male connector and FIG. 5H shows a sheet metal female connector of a different type. Each of these connector tips are old and well known and are shown herein as indicating the kinds of connector tips that may be used.

We claim:

1. A connector test adapter comprising a closely wound spring comprising a first portion having one diameter and a second portion having a larger diameter, a connector tip fastened to the first portion and projecting beyond the end thereof, said second portion being adapted to function as a banana jack receiving a banana plug, a plastic premolded insulating sleeve enclosing said spring and engaging the exterior of said first portion of said spring throughout substantially its entire length and the exterior of said second portion of said spring throughout substantially its entire length, said sleeve projecting axially beyond the free end of the portion of the spring having the larger diameter, and means between the interior of said sleeve and the exterior of said spring for inhibiting relative axial movement between the spring and the sleeve.

2. The connector test adapter set forth in claim 1 wherein said means for inhibiting relative axial movement comprises a radial portion on the interior of the sleeve adapted to engage the free end of the portion of the spring having the larger diameter.

3. The connector test adapter set forth in claim 1 wherein said means for inhibiting relative axial movement comprises solder positioned on the exterior surface of the portion of the spring having a large diameter and frictionally engaging the interior of the sleeve.

4. The connector test adapter set forth in claim 1 including a plurality of substantially identical test adapters, each of which has at least some of the connector pins having different configurations.

* * * * *